US007098864B2

(12) United States Patent
Ryan

(10) Patent No.: US 7,098,864 B2
(45) Date of Patent: Aug. 29, 2006

(54) TEMPORARY CELLULAR ANTENNA SITE

(75) Inventor: Ralph E. Ryan, Mountaintop, PA (US)

(73) Assignee: Creative Design and Machining, Inc., Clarks Summit, PA (US)

( * ) Notice: Subject to any disclaimer, the term of this patent is extended or adjusted under 35 U.S.C. 154(b) by 0 days.

(21) Appl. No.: 10/444,291

(22) Filed: May 23, 2003

(65) Prior Publication Data

US 2004/0233120 A1 Nov. 25, 2004

(51) Int. Cl.
*H01Q 1/12* (2006.01)

(52) U.S. Cl. ..... 343/890; 343/878; 343/891

(58) Field of Classification Search ..... 343/890, 343/874, 871, 878, 882, 880, 872, 893; H01Q 1/12
See application file for complete search history.

(56) References Cited

U.S. PATENT DOCUMENTS 3,579,244 A * 5/1971 Dempsey et al. ..... 343/797
4,146,897 A * 3/1979 Wilson et al. ..... 343/882
4,649,675 A * 3/1987 Moldovan et al. ..... 52/27
4,922,264 A * 5/1990 Fitzgerald et al. ..... 343/878
5,526,010 A * 6/1996 Plunk ..... 343/882
5,979,844 A * 11/1999 Hopkins ..... 248/158
6,340,790 B1 * 1/2002 Gordin et al. ..... 174/45 R
6,798,387 B1 * 9/2004 Cockell et al. ..... 343/878
2002/0140621 A1 * 10/2002 Harrison ..... 343/890

* cited by examiner

*Primary Examiner*—Trinh Vo Dinh
(74) *Attorney, Agent, or Firm*—Sanford J. Piltch, Esq.

(57) ABSTRACT

A small-footprint portable modular cellular antenna site capable of being deployed on any substantially level, flat piece of ground, the cellular antenna site being easily assembled, disassembled, and moved without the aid of heavy equipment. The cellular antenna site does not require a permanent foundation, but instead is anchored by weighting with a non-damaging ballast material sufficient to support a small diameter 30 to 60 foot high antenna pole at wind speed ratings up to 100 miles per hour. The cellular antenna site includes a modular base configurable in different geometric arrangements that retains the ballast material and supports a segmented monopole antenna, an electrical cabinet, perimeter fencing with an access gate, and any auxiliary cabinets, enclosure, or shelters as may be required.

17 Claims, 8 Drawing Sheets

10
30
12
30
18
30
52
16
40
44
50
46
24

TEMPORARY CELLULAR ANTENNA SITE

BACKGROUND OF THE INVENTION

The present invention relates generally to devices for cellular telephone transmission equipment and more particularly to a self-contained cellular antenna site adapted to be small in footprint, quickly assembled without the use of heavy equipment, and easily disassembled for transporting.

The continued proliferation and widespread use of wireless telecommunications equipment has brought with it the need for more self-contained cellular antenna sites. Typical methods of deploying cellular antennas are on permanent structures such as towers or monopoles, or on rooftops. When based on the ground, the permanent structures are normally supported on conventional foundations such as reinforced concrete slabs or pads, and often the concentrated weight of a tall antenna tower has required a relatively substantial and separate foundation member such as a deep reinforced concrete pier. Therefore, these structures often require special zoning and permitting, soil core sampling, engineering, excavation, and the use of heavy equipment and cranes to perform installation, all of which may be costly and time consuming. In addition, the time required to pour and cure a concrete foundation may delay the erection of an antenna and ultimately the operation of the cellular site. Further, such a permanent tower or monopole is not readily removed and redeployed at another site, and even if the tower or monopole itself is removed, the permanent foundation remains.

U.S. Pat. No. 6,131,349 [Hill] illustrates an attempt in the prior art to eliminate the need for construction of a separate foundation to support a cellular antenna tower. However, the apparatus disclosed utilizes the supporting foundation of the adjacent telecommunications equipment enclosure to provide load bearing support for the cellular antenna tower and therefore this design is not self-contained, is integrally connected to a permanent foundation, and cannot be quickly assembled or easily removed and relocated.

Developments in the newer generations of wireless systems have allowed both the antenna systems and the signal processing electronics packages to become smaller. A smaller antenna atop a pole of approximately 6 to 12 inches in diameter and a total height of 30 feet to 60 feet can now provide reasonable cellular coverage, enabling the design of cellular sites with decreased visual impact and decreased wind loading requirements. The present invention is designed to take advantage of these developments to provide a cellular antenna site which is much more flexible in its deployment than sites presently available.

Therefore, it is an object of the present invention to provide a cellular antenna site that is modular and inexpensive, and can be easily and quickly assembled, disassembled, and moved by hand without the use of heavy equipment. It is another object of the present invention to provide a cellular antenna site that is sufficiently anchored to support a small diameter 60 foot tall antenna pole under the sufficient loading to meet a 100 mile per hour wind speed rating. It is a further object of the present invention to provide a cellular antenna site that requires only a small footprint and can be situated on any relatively level and flat piece of ground.

It is yet another object of the present invention to provide a cellular antenna site that creates minimal environmental and visual impact in order to potentially ease zoning and permitting requirements and in order to allow for deployment in environmentally sensitive areas. It is still a further object of the present invention to provide a cellular antenna site that can accommodate an electrical cabinet and other required equipment, enclosures, or shelters, within a fenced and secure area.

Other objects will appear hereinafter.

SUMMARY OF THE INVENTION

The present invention overcomes the disadvantages inherent in the types of cellular antenna sites known in the prior art. The cellular antenna site of the present invention is of a modular construction that can be assembled from components and pre-fabricated sub-structures that are small and light enough to be manipulated by a team of two people. The cellular antenna site does not penetrate the ground on which it rests and can be situated on any relatively level and flat piece of ground, including a parking lot, a gravel lot, or a patch of grass or undeveloped land.

The base of the cellular antenna site of the present invention does not require any excavation or permanent foundation, but is instead anchored to the ground by a ballast comprising either concrete blocks, crushed gravel, poured concrete, or an equivalent material. Except in the case of poured concrete ballast, the entire cellular antenna site can be completely disassembled into its original component parts and removed from the location without leaving a trace of its having been installed. In the case of poured concrete ballast, the cellular antenna site may still be removed but it may require the removal of the entire base as one piece instead of disassembling the base into its component modules. The ballast material, when placed in the base modules, will form a substantially flat, level decking surface regardless of which of the ballast materials is actually used.

The cellular antenna site of the present invention, when assembled with three base modules each measuring 10 feet long by 3 feet 4 inches wide by 1 foot high and outfitted with a 6 to 12 inch diameter antenna pole ranging in overall height between 30 and 60 feet, has a nominal weight of approximately 2000 to 3000 pounds and a nominal footprint of 10 feet by 10 feet. When loaded with a ballast of concrete blocks, the site increases to a weight of about 10,000 pounds and is capable of achieving a 75 mile per hour wind speed rating. When loaded with a ballast of poured concrete, the site increases to a weight of about 15,000 pounds and is capable of achieving a 100 mile per hour wind speed rating.

In view of the preceding example, it is noted that due to the modular construction of the base, the site can be assembled into a wide variety of configurations and footprint dimensions, depending on the requirements of the specific deployed location. Expansion of the cellular antenna site base can be achieved by bolting additional base modules to any of the four sides of the base. It is also noted that the design concept of the cellular antenna site of the present invention can be applied using base modules of any nominal dimensions. It is further noted that the base modules need not be of rectangular shape and could in fact be of any geometric shape with straight edges to allow for interconnecting and mating with other base modules, including cooperating triangular and hexagonal shapes.

The base of the cellular antenna site of the present invention provides integral means for securing an electrical cabinet which houses the required telecommunications electronics, as well as means for mounting any other auxiliary enclosures, cabinets, or shelters. The base also includes integral means for mounting the hinged antenna base, so that the antenna may be first attached in a horizontal position and then erected by simply hoisting it into a vertical position about a hinge, avoiding any need for a crane. Once erected, the hinged antenna base can be secured to maintain the antenna in the vertical position. A simple weatherproof wiring harness electrically connects the antenna to the electrical cabinet. Additionally, the base of the cellular antenna site provides means for connection of a grounding stake to ensure that the entire apparatus of the present invention is properly grounded.

The base of the cellular antenna site further provides integral means for the mounting of fence posts to support a fence, e.g., wire mesh or wooden post, encircling the base and surrounding the antenna, electrical cabinet, and any auxiliary equipment, in addition to a hinged gate allowing easy access to the site while providing a measure of security, personnel safety, and protection of the wireless telecommunications equipment.

BRIEF DESCRIPTION OF THE DRAWINGS

For the purpose of illustrating the invention, there is shown in the drawings forms which are presently preferred; it being understood, however, that the invention is not limited to the precise arrangements and instrumentalities shown.

DETAILED DESCRIPTION OF THE PREFERRED EMBODIMENTS

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
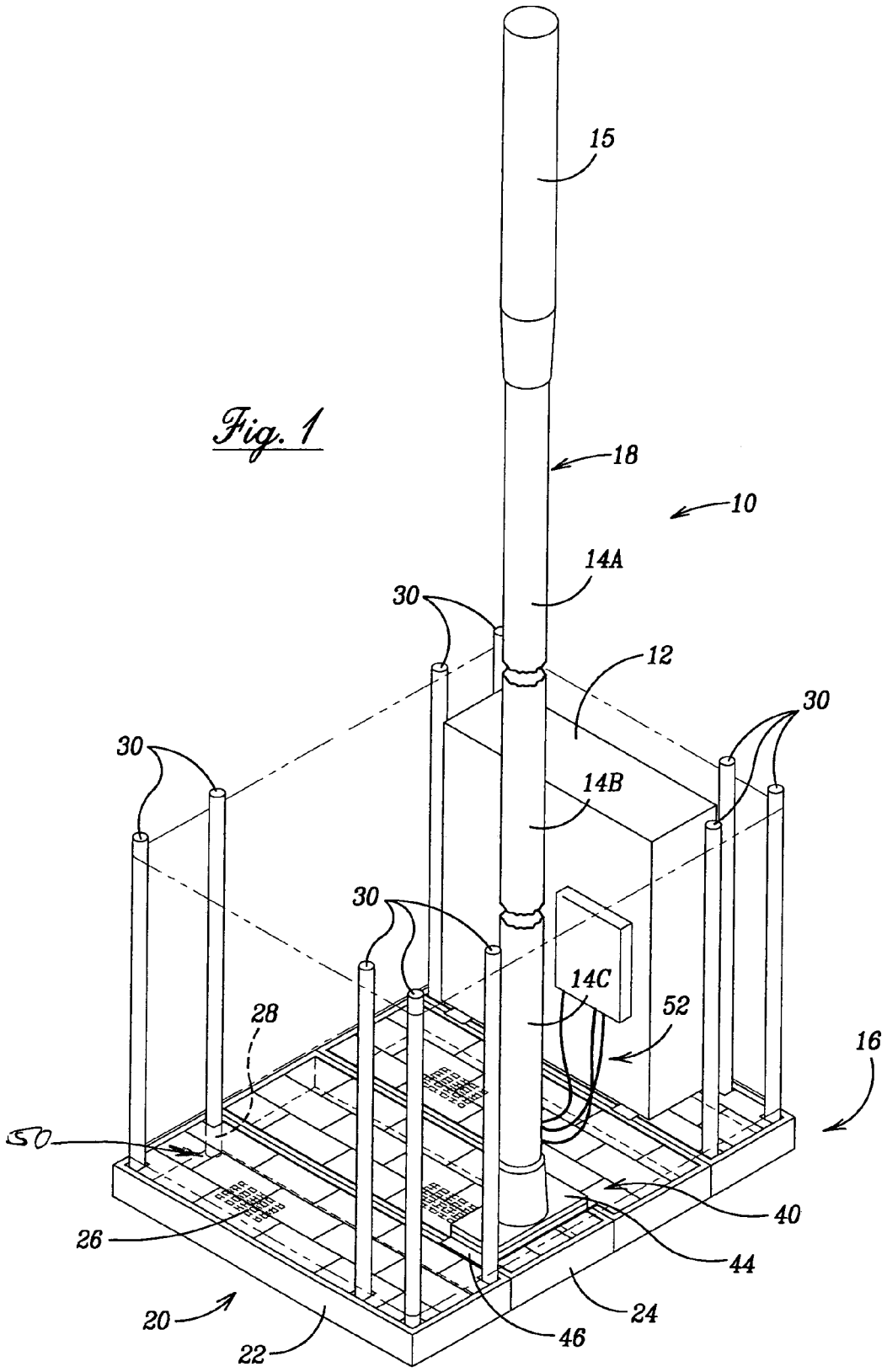
FIG. 1 is a perspective view of the temporary cellular antenna site of the present invention.

Referring now to the drawings in detail, where like numerals refer to like parts or elements, there is shown in FIG. 1 a perspective view of the temporary cellular antenna site apparatus 10. The apparatus 10 is of modular construction comprising a base 16, an antenna system 18, an electrical cabinet 12, fencing 38, and a grounding means (not shown). An additional component required for the functioning of the apparatus 10 is anchoring ballast, which may be in the form of concrete blocks 40, poured concrete 40*a*, crushed gravel 40*b*, or another equivalent material, as shown in FIGS. 2, 2A, and 2B, respectively.

The apparatus 10 is fabricated as a set of components, some of which are pre-assembled into sub-structures to facilitate onsite deployment. The apparatus 10 is easily transported to a required location and can be fully assembled and commissioned by two workers in a single day. Each base module 20 is approximately 10 feet long by 3 feet 4 inches wide by 1 foot high. The dimensions of a base module 20 are constrained to keep within a manageable weight and size, noting that many other sizes, shapes, and aspect ratios could be fabricated within the same weight range. The antenna pole 14 is available in lengths from 30 feet to 60 feet. Although a single length is preferred, the antenna pole 14 may be comprised of one or more segments. The antenna pole, or elongated support means 14, may be manufactured of metal, fiberglass, or composite materials and may be configured as either a monopole or as a lattice work tower, however for descriptive purposes, a monopole type antenna support 14 will serve as a model encompassing all of the other configurations.

Prior to assembly of the apparatus 10, a location should be selected that is relatively flat and level. Acceptable site locations include a parking lot, a gravel lot, a flat rooftop capable of supporting the required weight, and a relatively flat and level patch of grass or undeveloped ground. A temporary and non-damaging installation may be achieved by using an anchoring ballast of concrete blocks 40 or gravel 40*b*. A slightly more permanent installation may be achieved by using an anchoring ballast of poured concrete 40*a*. When using the concrete block ballast 40 or the gravel ballast 40*b*, a 60 foot antenna pole 14 is capable of achieving a 75 mile per hour wind speed rating. When using the poured concrete ballast 40*b*, the wind speed rating for a 60 foot antenna pole 14 is increased to 100 miles per hour.

Figure 2:
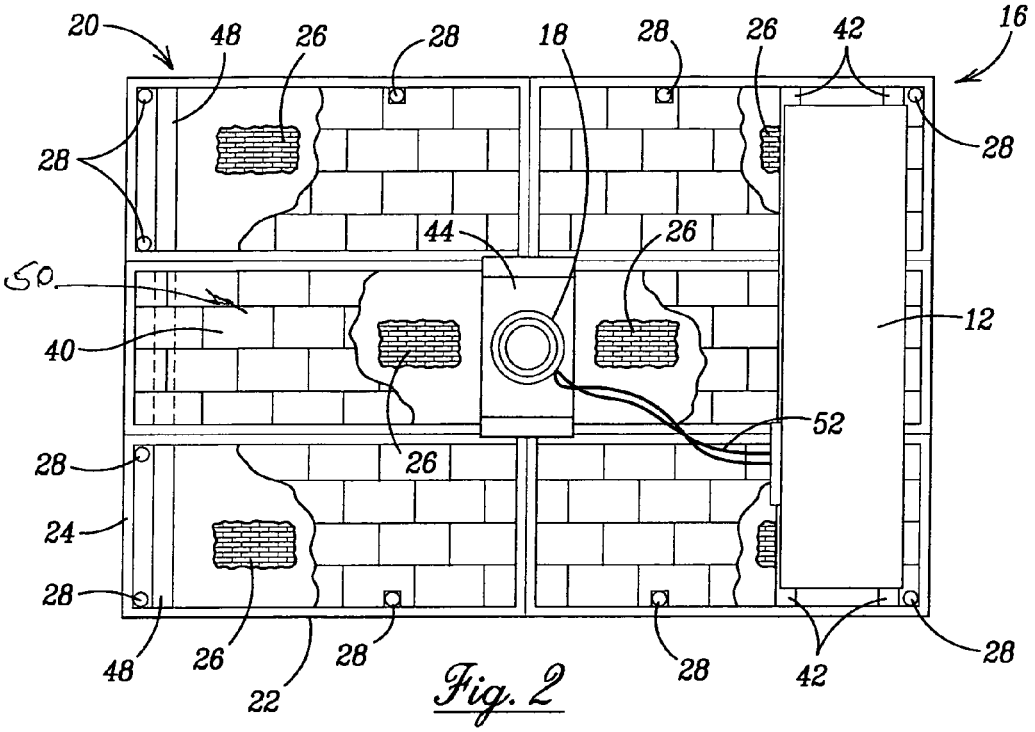
FIG. 2 is a top view of the temporary cellular antenna site of the present invention shown with concrete block used as the anchoring ballast.
Figure 2A:
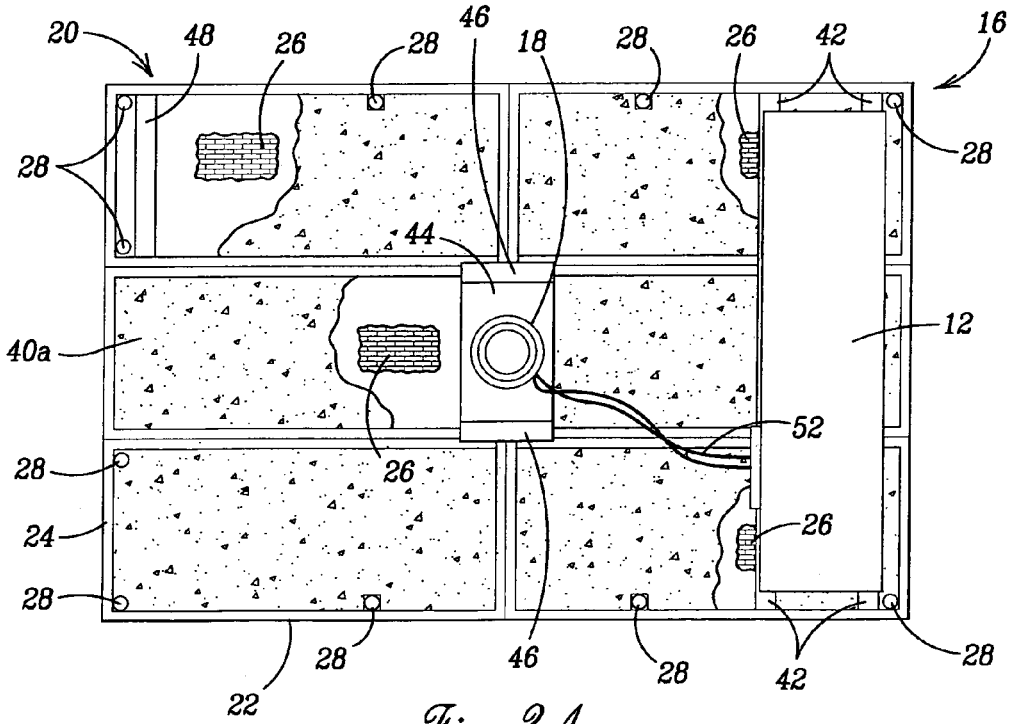
FIG. 2A is a top view of the temporary cellular antenna site of the present invention shown with poured concrete used as the anchoring ballast.
Figure 2B:
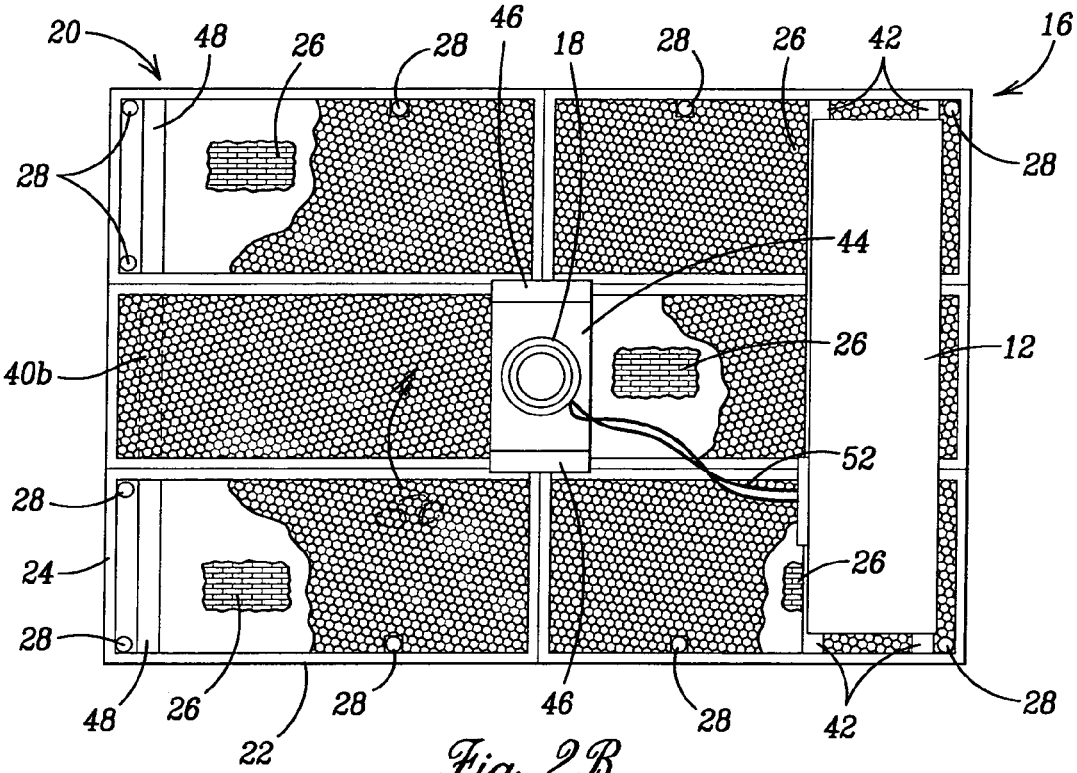
FIG. 2B is a top view of the temporary cellular antenna site of the present invention shown with gravel used as the anchoring ballast.
Figure 4:
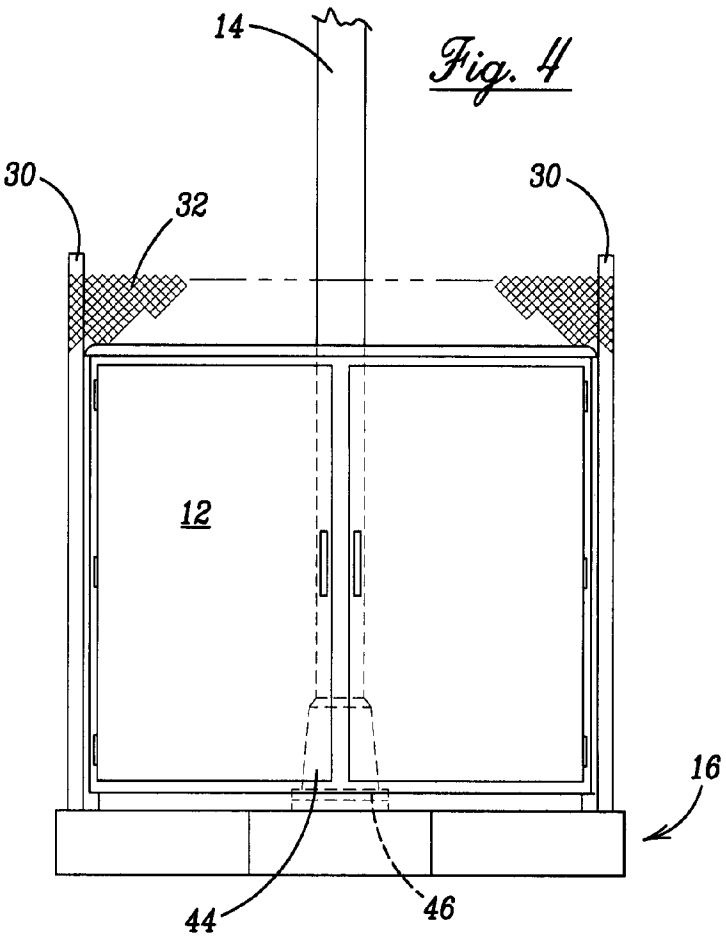
FIG. 4 is a front view of the temporary cellular antenna site of the present invention.
Figure 3:
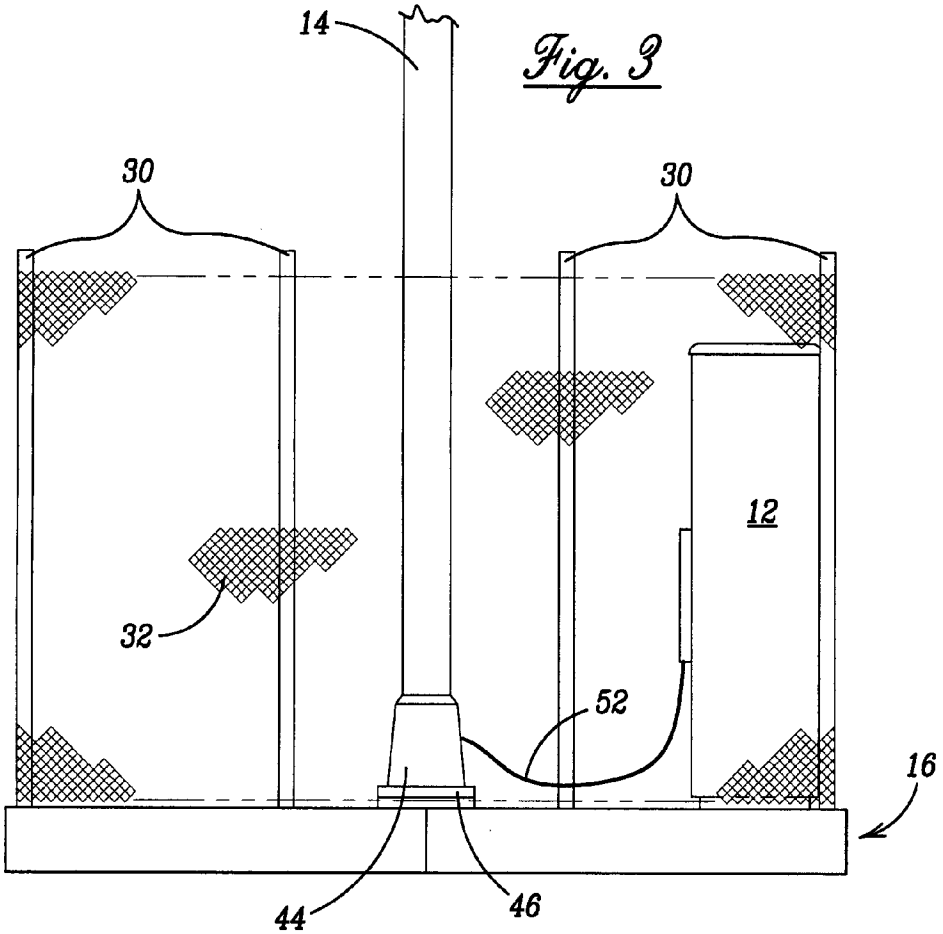
FIG. 3 is a side view of the temporary cellular antenna site of the present invention.
Figure 5:
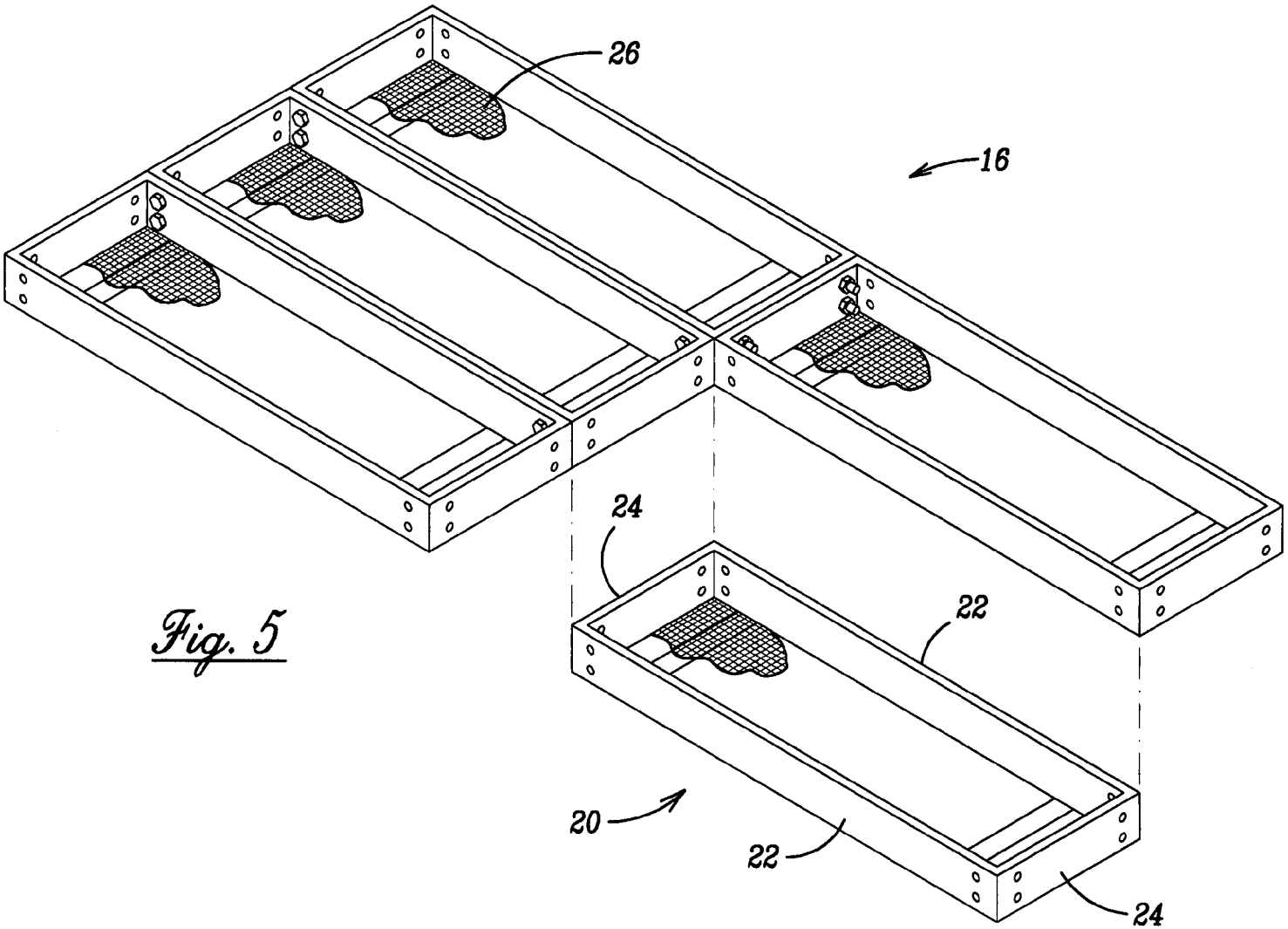
FIG. 5 is a perspective view of a partially assembled base of the temporary cellular site comprising a number of base modules attached to one another by fastening means in a predetermined configuration.

The detailed construction of the base 16 is best described in reference to FIG. 1 and the top view shown in FIG. 2. The base 16 is assembled from a combination of similar base modules 20. Each rectangular base module 20 comes pre-assembled and is formed by joining the ends of two side rails 22 with the ends of two end rails 24. The rails are joined by bolting, welding, or other equivalent joining means. Each side rail 22 and each end rail 24 is a galvanized steel C-channel member, although a similar lightweight and strong form such as a rectangular tube or I-beam may be used. When assembled to form the frame of a base module 20, a side rail 22 thereof is capable of being butted up against and bolted to the side rail 22 or the end rail 24 of another base module 20; likewise an end rail 24 thereof is capable of being butted up against and bolted to the end rail 24 or the side rail 22 of another base module 20. In this manner, base modules 20 may be interconnected to create a base 16 of various sizes, shapes, and aspect ratios. See FIG. 5.

Further comprising each base module 20 is an expanded metal grating or screen 26 which is rigidly attached along all four of its edges to the underside of the side rails 22 and the end rails 24 thereof to form a lightweight mesh bottom of the base module 20. The mesh bottom formed by the metal grating 26 is capable of supporting and retaining the ballast material 40, 40*a*, or 40*b*. The ballast material of concrete blocks 40, poured concrete 40*a* or crushed stone or gravel 40*b*, when placed in the base modules 20, will form a substantially flat, level decking surface 50 between the plurality of perimeter rails 22, 24 of each base module 20 of the antenna base 16 of the present invention. In each case the ballast material 40, 40*a* or 40*b* will extend upward to approximately the height of the perimeter rails 22, 24 of the base modules 20 as shown in FIGS. 1, 2, 2A and 2B. In this fashion a flat, level decking surface 50 is formed using the ballast material instead of having to construct such a deck using either prefabricated materials or other materials fabricated on site.

Fence post sleeves 28, integrally secured along the inner edges of the side rails 22 and the end rails 24 of the base 16, provide a means for mounting the perimeter fencing 38. Pre-drilled mounting holes at various positions along the side rails 22 are adapted for bolting the base plate 46 and hinged antenna base 44 and the electrical cabinet support members 42. Optional mounting support members 48 may be connected across any base module 20 between the side rails 22 thereof, also utilizing the mounting holes, to provide additional structural integrity and to provide means to mount auxiliary equipment cabinets, enclosures, or shelters as desired.

Thus, each base module 20 is a rectangular frame comprising the two side rails 22, the two end rails 24, the metal grating 26 across the bottom thereof, the fence post sleeves 28 facing vertically upward, and the mounting means to attach the hinged antenna base 44, the electrical cabinet support members 48, and the optional support members 42, as required. Once each base module 20 is positioned where desired on the ground, multiple base modules 20 are interconnected to form the base 16. The base may be of various configurations. For example, in FIG. 1, four base modules 20 are connected side-to-side to form the base 16. In another example, in FIG. 2, six base modules 20 are interconnected in a three by two configuration with two sets of three base modules 20 each connected side-to-side and then the two sets of three connected to each other end-to-end to form the base 16. See also, FIG. 5. Other similar, and different geometric configurations may be conceived.

Figure 6:
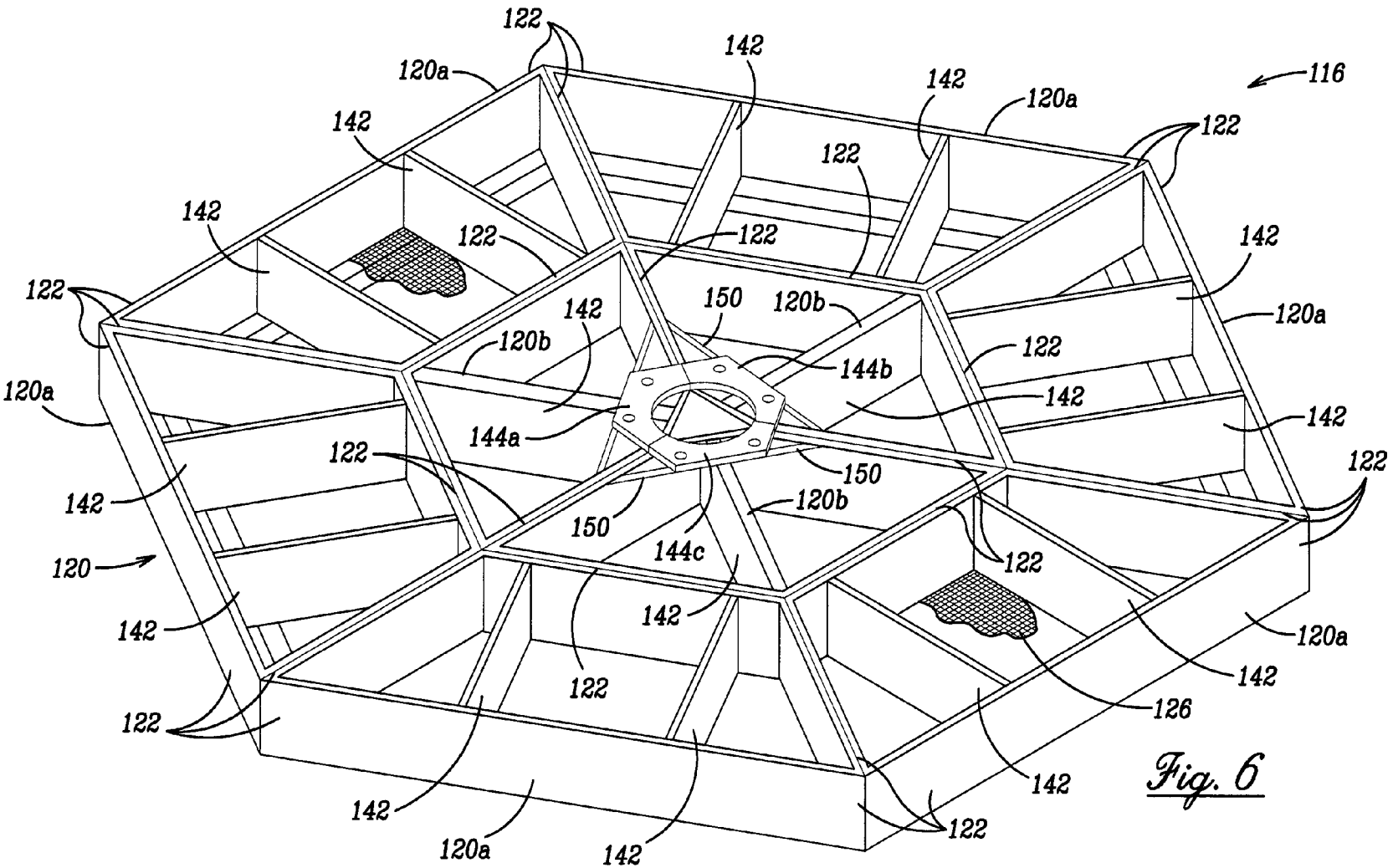
FIG. 6 is a perspective view of a base assembly of a second embodiment of the temporary cellular site comprising a number of base modules having a trapezoidal configuration arrayed around a smaller number of base modules having a diamond configuration attached to one another by fastening means in the arrangement shown.

Before continuing with a further description of the base assembly 16 of the temporary cellular site, a second arrangement of interconnected base modules can be assembled. This arrangement of base modules 120 in a hexagonal base 116 is shown in FIG. 6. There are two types of base modules in this arrangement, a trapezoidal base module 120*a* and a diamond base module 120*b*. The trapezoidal base modules 120*a* are arrayed around three central diamond base modules 120*b*. The diamond base modules 120*b* are shown having like triangular sections of equal length legs with a support member 142 extending along the common base of the triangular sections. The dimensional relationship of this base assembly 116 is similar to the rectangular base assembly 16 in that the overall dimension across the hexagonal shape is a similar twenty (20) feet taken along a line directly through the center of the hexagon from an interconnection point between two adjacent trapezoidal base modules 120*a* to the same interconnection point between two adjacent trapezoidal base modules 120*a* on the opposite side of the hexagon. In this way the dimensional footprint of the temporary cellular antenna site remains substantially the same regardless of the base assembly configuration.

Each triangular section of the diamond base modules 120*b* has an external sidewall 122 for interconnecting to the outer ring of trapezoidal base modules 120*a* and to the other diamond base modules 120*b*. Likewise, each of the trapezoidal base modules 120*a* has an external sidewall 122 for interconnecting to the other trapezoidal base modules 120*a* and to the diamond base modules 120*b*. The trapezoidal base modules 120*a* also have an external sidewall 122 facing outward forming one base of the trapezoid shape. The other base of the trapezoid shape is dimensioned to be of equal length to one of the legs of a triangular section of the diamond base modules 120*b* such that the external sidewalls 122 of the base modules 120*a*, 120*b* fit tightly together. The interconnecting sidewalls 122 are held together by fastening means as described in connection with the other base assembly 16.

At the center of the interconnected diamond base modules 120*b* are three segmented antenna base members 144*a, b, c,* each such segment being mounted to one of the three diamond base modules 120*b*. The three segments of the antenna base 144*a, b*, and *c* cooperatively engage to form a hexagonal base member 144 to which the antenna pole 14 is bolted through the respective mounting holes. To support the antenna base 144 and to keep the base from tilting from the horizontal position, support arms 150 are arranged to extend adjacent to and beneath the edges of the antenna base member 144. The support arms 150 extend between interconnecting sidewalls 122 of adjacent triangular sections of each diamond base module 120*b*, supported at their respective approximate midpoints by the support members 142 extending across the diamond base modules 120*b*. At the center of the antenna base member 144 is a triangular reinforcing member 145 to provide added stabilization to the base connection for support of the antenna tower 14.

Extending across the distance between the bases of the trapezoidal base modules 120*a* are support members 142 to provide substantial rigidity to the sidewalls 122 of the base modules. This strengthening of the base 116 provides the rigidity to withstand deformation or distortion of the base from wind forces against the elongated support member 14 and the antenna 15. Along the downward facing edges of the sidewalls 122 of the base modules 120*a*, 120*b* metal grating 126 is attached to retain anchoring ballast to provide a sufficient weight factor to withstand the wind or shear forces exerted against the antenna tower.

Although this embodiment has a different configuration than that of FIGS. 1–5, the similar elements permit for the assembly of the base systems along with the peripheral elements described more fully below in connection with the first embodiment. It is to be understood that each of the elements described below can be fitted to be used with the hexagonal base assembly 116 in a similar fashion and being attached or mounted in a similar way as that described below.

The next step in assembly of the temporary cellular antenna site apparatus 10 is to anchor the base 16 at its desired location. A temporary and easily removable anchoring ballast of concrete blocks 40 or crushed gravel 40*b* may be used. A more permanent but still removable ballast of poured concrete 40*a* may be used, since the metal grating 26 creates a floor for the poured concrete form that prevents the concrete from binding to the surface below.

As described above, the ballast material of concrete blocks 40, poured concrete 40*a* or crushed stone or gravel 40*b*, when placed in the base modules 20, will form a substantially flat, level decking surface 50 between the plurality of perimeter rails 22, 24 of each base module 20 of the antenna base 16 of the present invention. The ballast material 40, 40*a* or 40*b* will extend upward to approximately the height of the perimeter rails 22, 24 of the base modules 20 as shown in FIGS. 1, 2, 2A and 28 creating a flat, level decking surface 50 using the ballast material instead of having to construct the decking using either prefabricated materials or other materials fabricated on site.

Once the base 16 is constructed and anchored with the ballast material 40, 40*a,* or 40*b,* the electrical cabinet 12 is mounted. The electrical cabinet support members 42 are connected across a base module 20 and secured between the side rails 22 thereof using predrilled mounting holes, at the position on the base 16 where the electrical cabinet 12 will be located. The members 42 provide structural support for mounting the electrical cabinet 12 within the perimeter fencing 38 surrounding the base 16. The cabinet 12 may also be free standing outside of the perimeter fencing 38, if the size of the electrical cabinet 12 and the physical constraints of the mounting location on the base 16 are exceeded. The electrical cabinet 12 is secured to the cabinet support members 42. A grounding stake (not shown), electrically connected to the electrical cabinet 12, is used to provide an earth ground for the electrical cabinet 12 as well as for the entire apparatus 10. External wiring 52 connects the electrical cabinet components to the antenna 15 as described below.

Figure 7:
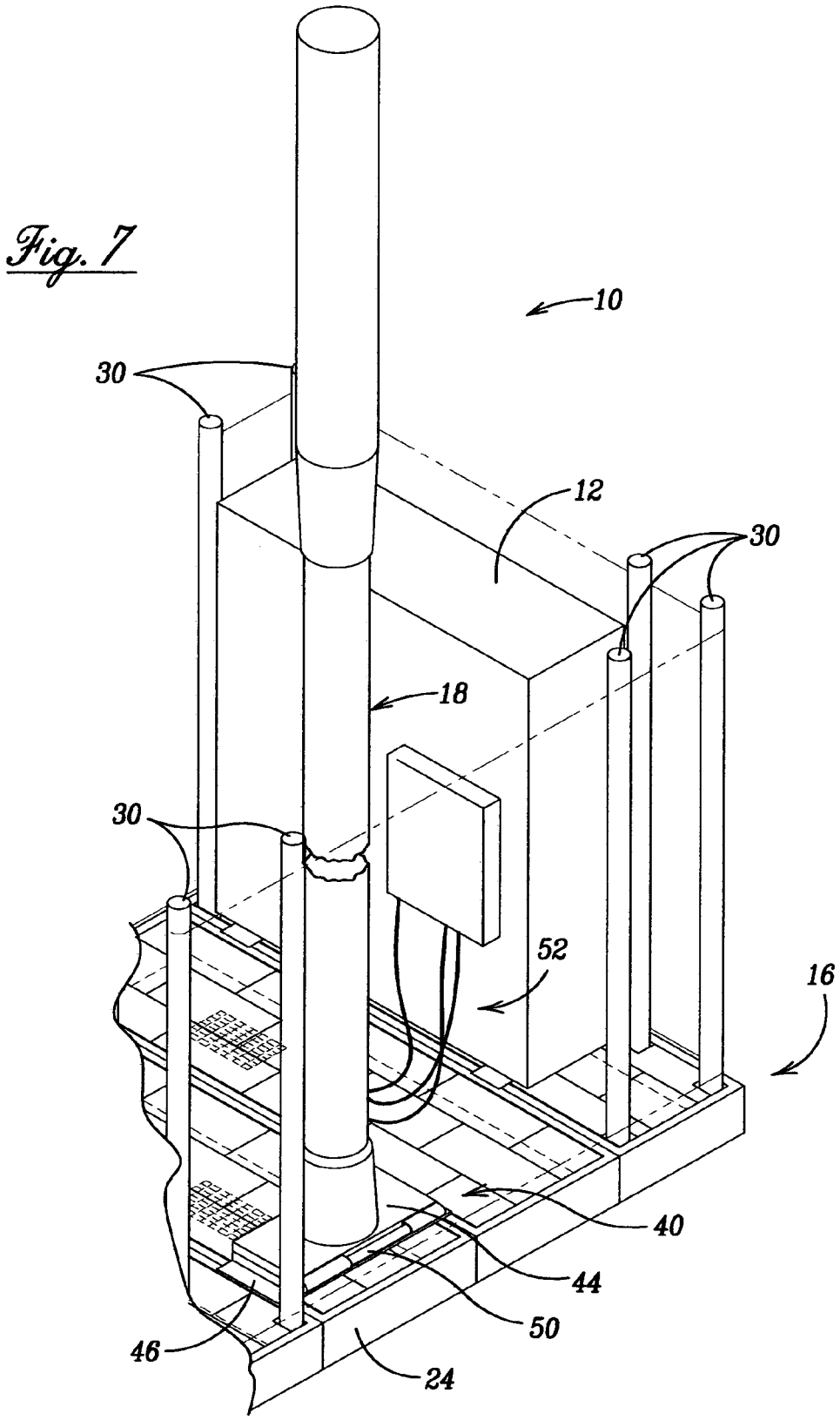
FIG 7 is a partial perspective view of the temporary cellular site of the present invention showing the hinge between the lower and upper portions of the antenna.
Figure 8:
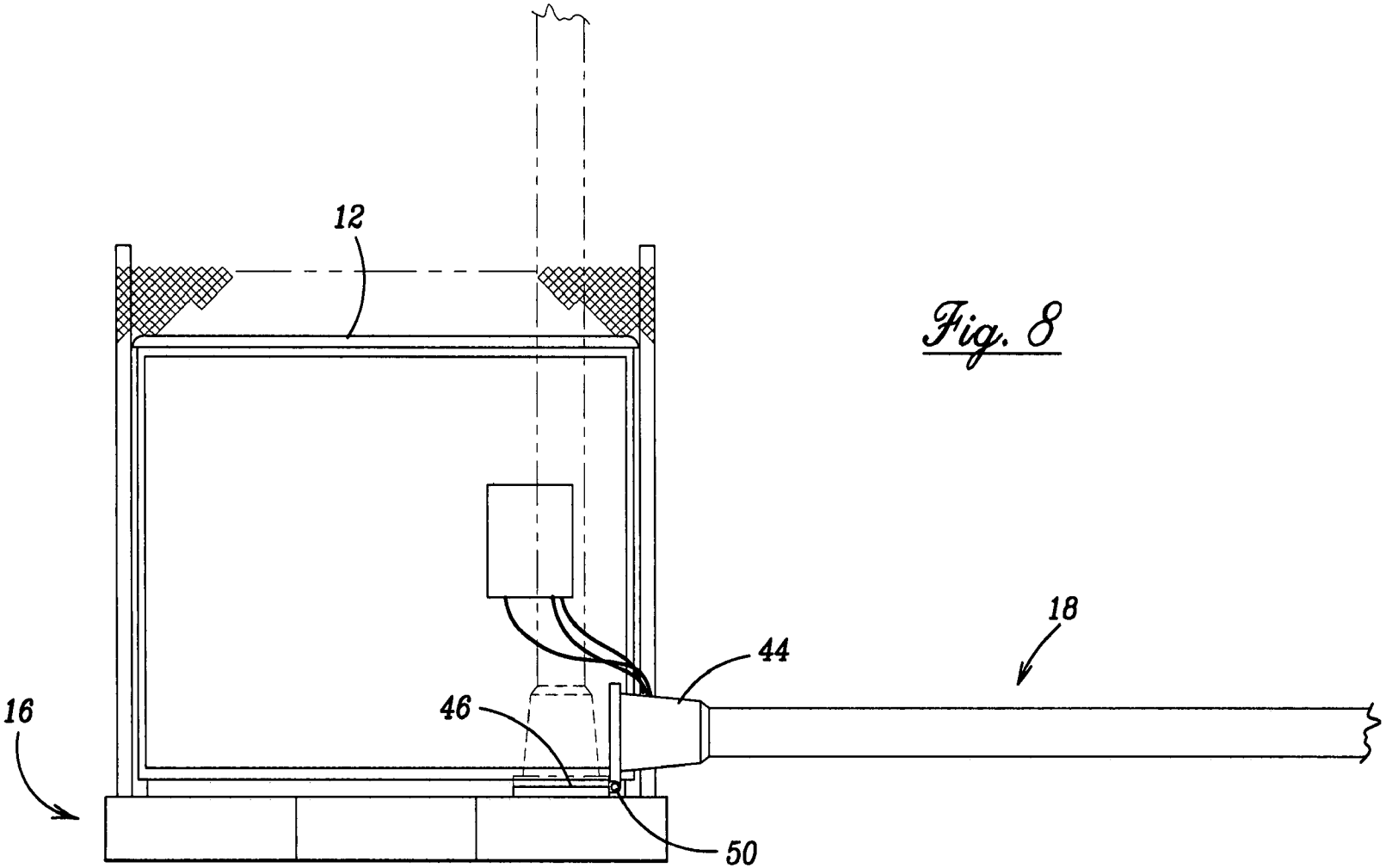
FIG 8 is a side view of the temporary cellular site of the present invention showing the hinge between the lower and upper portions of the antenna.

Prior to installing the perimeter fencing 38, the antenna system 18 is installed. First, the base plate 46 is positioned in a desired location on the base 16 and secured to the side rails 22 at the base module 20 at that location using the predrilled mounting holes. The bottom portion of the hinged antenna base 44 is mounted to the base plate 46 using appropriately sized mounting hardware. The tapered aluminum antenna pole 14, or the bottom segment 14C of the antenna pole, is attached in a horizontal position to the top pivoting portion of the hinged antenna base 44. A hinge 50, extending along an entire side, connects the top pivoting portion and the bottom portion of the hinged antenna base 44. Additional antenna pole segments 14B and 14A are then added and secured to the previously mounted segment, if a segmented antenna pole is being utilized, and the antenna 15 is positioned at the top of the assembly. The assembled antenna system 18 is then erected to its standing position by being hoisted in a pivoting motion about the hinge 50 of the antenna base 44. See, FIGS. 7 and 8. Once erected the antenna pole 14 is secured in a vertical position by bolting, clamping, or equivalent removable securing means. Signal connections are accomplished between the antenna 15, along the antenna pole 14 and into the electrical cabinet 12 by means of a waterproof electrical wiring harness 52.

Perimeter fencing 38 may be erected by inserting the fence posts 30 into the fence post sleeves 28 and securing the desired fencing material 32 to the fence posts 30 around the perimeter of the base 16. The fencing may be of wire mesh, wooden post, or any similar fencing material providing securable access to the antenna system on the temporary cellular antenna system 18, etc. A hinged access gate 36 is provided to fit between one pair of fence posts 30 to provide for personnel access to the antenna system 18, to the electrical cabinet 12 if it is inside the perimeter fencing 38, and to the interior of the fenced space of the apparatus 10.

After assembling the base 16 from the base modules 20, anchoring the base 16 with the ballast material 40, 40*a,* or 40*b,* mounting the electrical cabinet 12, erecting the antenna system 18, connecting the wiring harness 52 between the antenna 15 and the electrical cabinet 12, and erecting the fencing 38 around the perimeter of the base 16, the temporary cellular antenna site apparatus 10 is ready for use. The only external connections required are the power and communication links. The apparatus 10 can be operated for as long as is required. If and when it is desired to remove the apparatus 10 for use in another location or in favor of a more permanent cellular antenna site, the apparatus 10 may be disassembled into its component parts and removed.

Disassembly of the apparatus 10 is the reverse of assembly. The perimeter fencing 38 is removed by detaching the fence 32 and the hinged access gate 36 from the fence posts 30 and by removing the fence posts 30 from the fence post sleeves 28. The wiring harness 52 is detached from the antenna 15 and the electrical cabinet 12. The antenna pole 14 is lowered by pivoting about the hinge of the hinged antenna base 44 and is disconnected from the antenna base 44 and disassembled from the hinged base 44. The antenna base 44 is then removed from the side rails 22 of the base module 20 to which it was mounted. The electrical cabinet 12 is removed from its support members 42, and the support members 42 are disconnected from the side rails 22 of the base module 20 to which they were mounted. The grounding stake (not shown) disconnected from the electrical cabinet 12 and is pulled from the ground.

If a temporary ballast such as concrete blocks 40 or gravel 40*b* was used, this ballast is removed and the base modules 20 are disconnected from each other. If a more permanent ballast such as poured concrete 40*a* was used, removal of the ballast and disconnection of the base modules 20 from each other may not be possible and the base 16 may need to be removed as one piece. The components of the apparatus 10 may be relocated and reassembled as described previously.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

The invention claimed is:

1. A cellular antenna site adapted to be located on any substantially level, flat surface comprising:

an antenna system mounted to an elongated support pole;

a portable base comprised of a plurality of base modules, each base module including a perimeter rail and a module bottom integrally attached to the underside of said perimeter rail, said perimeter rail and said module bottom forming a space capable of retaining a ballast material, said ballast material utilized to form a substantially flat, level decking surface;

said base being formed by interconnecting said base modules to each other using removable connecting means to join the respective perimeter rails thereof, said base including one or more antenna support members on the top side thereof, said antenna support members being capable of bearing the weight of said antenna system;

a removable antenna mounting means for mounting said antenna system to said base with said antenna system in a vertical orientation extending upwards from the decking surface along the top side of said base.

2. The cellular antenna site of claim 1, wherein said elongated support pole comprises multiple longitudinal segments removably connected to each other at the respective ends thereof.

3. The cellular antenna site of claim 1, wherein the module bottom of said base modules is a metal grating.

4. The cellular antenna site of claim 1, wherein said removable antenna mounting means is comprised of a lower portion, an upper portion, and a hinge connecting said lower portion to said upper portion, said lower portion being removably connected to said antenna support members of said base and said upper portion being removably connected to the bottom of said antenna system, enabling said antenna to be mounted to said upper portion while said antenna is in a horizontal position and further enabling said mounted antenna to be hoisted about said hinge to a vertical position, said antenna mounting means further including a securing means for securing said antenna in the vertical position.

5. The cellular antenna site of claim 1, wherein said base further includes one or more removable support members adapted for attaching an enclosure to the top side of said, base, said support members further being capable of supporting an enclosure positioned adjacent to said base.

6. The cellular antenna site of claim 5 further comprising an electrical cabinet removably mounted to said support members and a wiring harness connecting said electrical cabinet to said antenna system, said electrical cabinet containing the telecommunications electronics for said cellular antenna site to be self-contained with the exception of external power and communications links.

7. The cellular antenna site of claim 1, wherein each said base module further includes a plurality of integral fence mounting sleeves around the perimeter thereof.

8. The cellular antenna site of claim 7 further comprising:

a plurality of fence posts mounted into said fence mounting sleeves around the perimeter of said base, an access gate hingedly mounted between two of said fence posts enabling personnel access to the base, a length of fence secured to said fence posts, said fence being erected to encircle the perimeter of said base except for the perimeter section occupied by said access gate.

9. The cellular antenna site of claim 1, wherein said ballast material comprises a plurality of concrete blocks.

10. The cellular antenna site of claim 1, wherein said ballast material comprises poured concrete.

11. The cellular antenna site of claim 1, wherein said ballast material comprises crushed stone.

12. A method of deploying a cellular antenna site having a base comprising a plurality of base modules each having perimeter rails and a module bottom; an elongated support means having an antenna system mounted thereto, a mounting means for attaching said elongated support means to said base; an electrical cabinet containing communications electronics necessary for said cellular antenna site to be self-contained with the exception of external power and communications links; a wiring harness for interconnecting said antenna system to said electrical cabinet; a plurality of support members capable of supporting said elongated support means and said electrical cabinet on said base; said method comprising the steps of:

situating said base modules on a substantially level, flat piece of ground and removably joining together the perimeter rails thereof to form said base, filling said base modules with a ballast material, said ballast material selected from one of a group consisting of concrete blocks, poured concrete, or crushed stone, removably connecting the bottom portion of said mounting means to one or more of said support members on the top of said base, mounting said antenna system to said mounting means by removably connecting the top portion of said mounting means to the bottom of said elongated support means in horizontal orientation, hoisting said elongated support means about a hinge connecting said bottom and top portions of said mounting means into a vertical orientation, and securing said mounting means to maintain said elongated support means having a cellular antenna system mounted thereto in a vertical orientation using a removable securing means, and mounting said electrical cabinet to one or more of said support members on the top of said base, interconnecting said wiring harness between said antenna system and said electrical cabinet.

13. The method of claim 12 further comprising a mounting means including a bottom portion, a top portion, and a hinge, and further comprising the step of elevating said elongated support means from a horizontal to a vertical position.

14. The method of claim 12 further comprising fencing including fence posts, fencing material, and a hinged access gate; and fence past sleeves integrally mounted to said base capable of receiving said fence posts, and further comprising the step of erecting said fencing by inserting said fence posts into said fence post sleeves, mounting said hinged access gate between two of said fence posts, and securing said fence to said fence posts around the perimeter of said base except for the perimeter section occupied by said access gate.

15. A method of deploying a cellular antenna site having a base comprising a plurality of base modules each having perimeter rails and a module bottom; an elongated support means having an antenna system mounted thereto, a mounting means for attaching said elongated support means to said base; an electrical cabinet containing the communications electronics necessary for said cellular antenna site to be self-contained with the exception of external power and communications links; a wiring harness for interconnecting said antenna system to said electrical cabinet; a plurality of support members capable of supporting said elongated support means and said electrical cabinet on said base; said method comprising the steps of;

situating said base modules on a substantially level, flat piece of ground and removably joining together the perimeter rails thereof to form said base.

filling said base modules with a ballast material, said ballast material selected from one of a group consisting of concrete blocks, poured concrete, or crushed stone, for forming a substantially flat level decking surface.

removably connecting said mounting means to one or more of said support members on the top of said base along the decking surface, mounting said antenna system to said mounting means by removably connecting the bottom of said elongated support means in a vertical orientation extending upwards from the decking surface along the top side of said base, and mounting said electrical cabinet to one or more of said support members on the top of said base, interconnecting said wiring harness between said antenna system and said electrical cabinet.

16. The method of claim 15 further comprising the step of mounting and connecting multiple longitudinal segments removably connected to each other at the respective ends thereof to form said elongated support pole.

17. The method of claim 15 further comprising fencing including fence posts, fencing material, and a hinged access gate; and fence post sleeves integrally mounted to said base capable of receiving said fence posts, and further comprising the step of erecting said fencing by inserting said fence posts into said fence post sleeves, mounting said hinged access gate between two of said fence posts, and securing said fence to said fence posts around the perimeter of said base except for the perimeter section occupied by said access gate.

* * * * *